US005115700A

United States Patent [19]

Kaler, 2nd

[11] Patent Number: 5,115,700

[45] Date of Patent: May 26, 1992

[54] STRAP WRENCH

[76] Inventor: Dickie M. Kaler, 2nd, P.O. Box 121, Rim Rock, Ariz. 86335

[21] Appl. No.: 749,609

[22] Filed: Aug. 26, 1991

[51] Int. Cl.[5] ..... B25B 13/52

[52] U.S. Cl. ..... 81/64; 81/65

[58] Field of Search ..... 81/64, 65, 65.2, 68, 81/69, 70, 65.4

[56] References Cited

U.S. PATENT DOCUMENTS 1,512,014 10/1924 Bryar ..... 81/65

4,079,642 3/1978 Scott ..... 81/64

*Primary Examiner*—Bruce M. Kisliuk

*Assistant Examiner*—Lawrence Cruz

*Attorney, Agent, or Firm*—James F. Duffy

[57] ABSTRACT

A strap wrench made up of a semi-rigid, form retaining, planar strip wrap around. This wrap around is formed into a shape retaining loop, the opening of the loop being readily adjustable. Because of the semi-rigid, form retaining characteristics of the wrap around strip, the loop will retain its shape and size as it is moved about and positioned over an object to be rotated. A simple squeeze of the strip will conform the size of the loop to the outer diameter of the object to be rotated. A flexible pull cord is attached to the fore end of the semi-rigid, form retaining strip and wrapped about the strip prior to or as the strip is placed about the object to be rotated. A simple straight line pull on the flexible cord exerts a force which acts along a line which is tangent to the object to be rotated and which acts at a distance removed from the axis of that object.

19 Claims, 1 Drawing Sheet

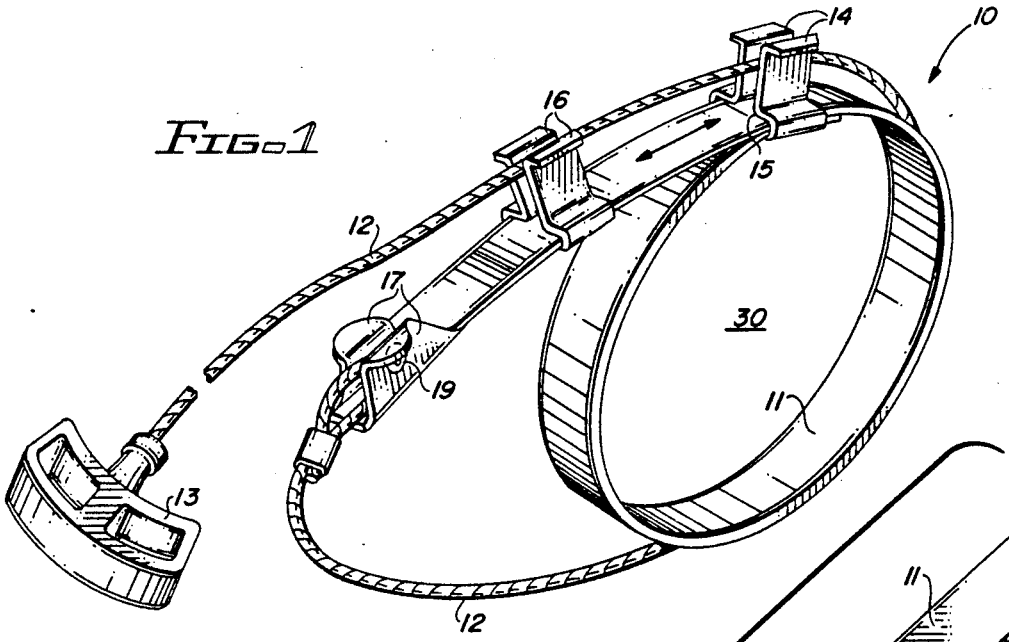
FIG. 1
FIG. 2
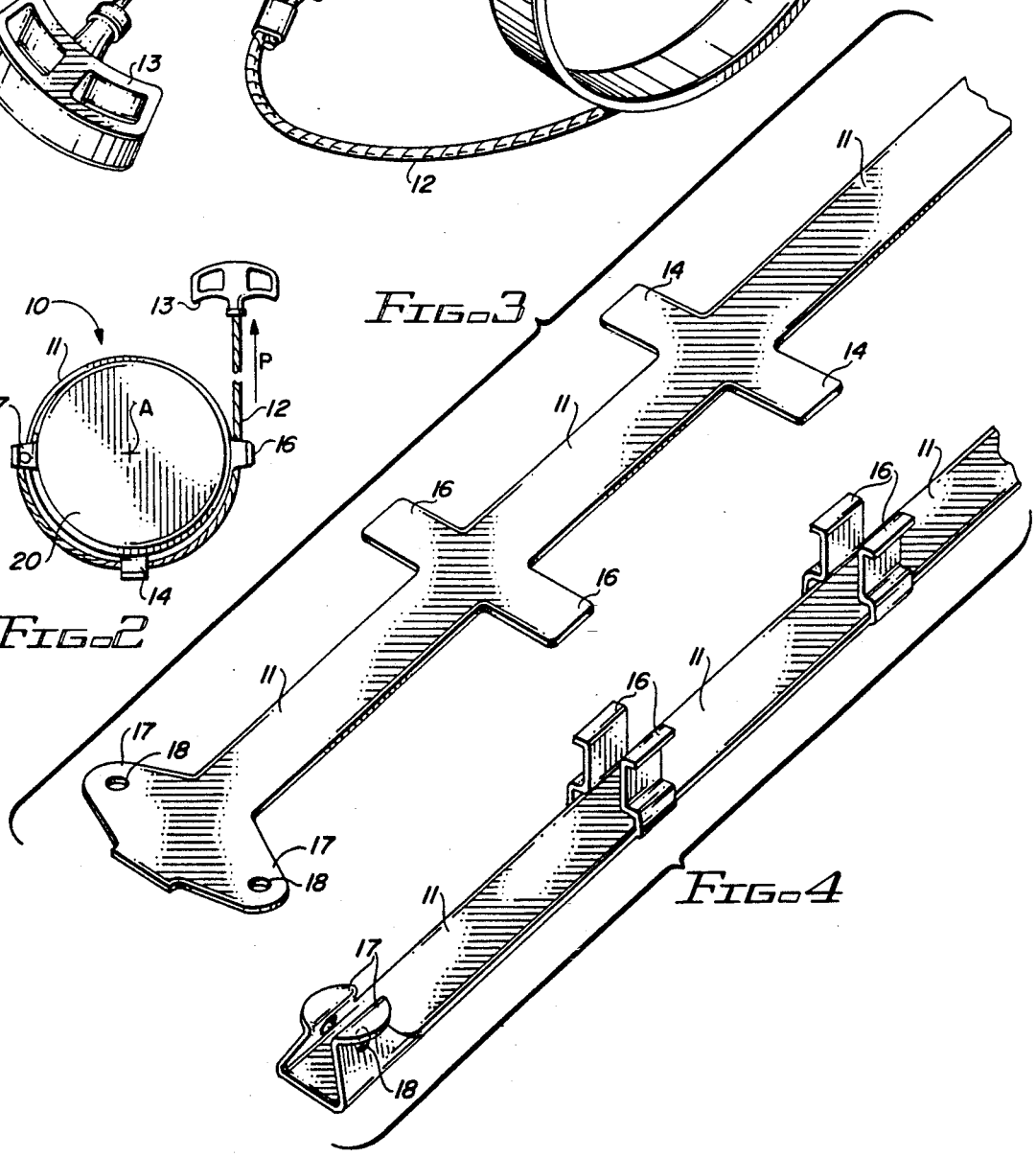
FIG. 3
FIG. 4

STRAP WRENCH

BACKGROUND

1. Field of the Invention

The invention relates to strap wrenches. Strap wrenches are those whereby tension is applied to a wrapping about an object to be rotated so as to induce a moment of force about the object. Those strap wrenches which require the actuation of a lever handle do not form part of the instant invention. Rather, the instant invention is a strap wrench which is actuated by a straight line pull acting in a plane orthoginal to the axis of the object to be rotated.

2. Prior Art

Strap wrenches come in various shapes, styles, and sizes. Most strap wrenches include a lever handle which acts as a shaft whose extended axis would generally pass through the axis of rotation of an object to be rotated. Indeed, a force diagram would make it appear as though the lever arm was pivoting about a fulcrum on the axis of rotation of the object being rotated.

A further distinguishing feature of prior art strap wrenches is that a significant amount of preparation is required before the strap wrench is used. The steps of preparation generally require the wrapping of the strap about the object to be rotated. Most of the straps are made of flexible materials which do not retain a looped shape approximating the diameter of the object to be rotated. Therefore, some manipulation is required to establish a loop in the strap and affix it to the object to be rotated. This can be frustrating in working in tight quarters.

It is an object of the present invention that leveraging action, which can consume significant amount of space and hinder operation within cramped quarters, will be eliminated and a straight line force acting along a line generally tangential to the object to be rotated will be substituted for the lever action where the lever appears to pivot at a fulcrum on the axis of rotation of the object.

It is a further object of the invention to provide a looped wrap around which is semi-rigid and form retaining so that it may be set to the approximate diameter of the object to be rotated prior to making a near approach to that object. Final adjustment of the diameter of the wrench to that of the object will require a simple squeeze of the loop to conform its diameter to that of the object.

SUMMARY OF THE INVENTION

The invention is a strap wrench made up of a semi-rigid, form retaining, wrap around, planar strip. The wrap around strip has a first end and a second end. There are slide coupling means adjacent the first end for slidingly receiving the second end and forming the wrap around strip into a semi-rigid, form retaining, size adjustable loop. A pull cord is coupled to the second end of the wrap around strip.

The slide coupling means further comprises pull cord guide means for guiding the pull cord when the pull cord is wrapped about the size adjustable loop formed from the wrap around strip. There are pull cord coupling means attached to the second end of the wrap around strip for coupling the pull cord to the second end. The pull cord coupling means also comprise pull cord guide means. Other pull cord guide means may be attached to the wrap around strip at other positions along the strip.

In a presently preferred embodiment, the semi-rigid, form retaining wrap around comprises a generally flat strip of at least one of sheet metal and sheet plastic. The flat strip comprises conformable tab means; and, the slide coupling means comprises a first one of the tab means. The slide coupling means further comprises pull cord guide means for guiding the pull cord. A second one of the tab means positioned at a selected position along the length of the flat strip is also used for guiding the pull cord.

A third one of the tab means comprises pull cord coupling means attached to the second end of the wrap around strip for coupling the pull cord to the second end. As before noted, the pull cord coupling means further comprises pull cord guide means for guiding the pull cord when the pull cord is wrapped about the size adjustable loop formed from the wrap around strip.

A primary distinguishing feature of the invention lies in the manner in which force is applied to rotate an object. The wrench-force is applied in a straight line generally acting along a tangent to the object being rotated. This force is applied by a straight line pull on a flexible cord, the force exerted being tangent to the object being rotated and removed a distance from the axis of rotation of the object. Prior art, lever actuated, strap wrenches applied their actuating force to a lever with an apparent fulcrum at that rotational axis.

DESCRIPTION OF THE DRAWINGS

FIG. 1 is a perspective view of the strap wrench of the invention showing the semi-rigid, form retaining wrap around, planar strip which readily conforms to the diameter of an object to be rotated by a simple squeeze operation.

FIG. 2 illustrates the strap wrench positioned on an object, for example, an oil filter, to be rotated by a straight line pull on the pull-cord of the strap wrench.

FIG. 3 is a segmented drawing of the planar strip from which the semi-rigid, form retaining wrap around may be fabricated.

FIG. 4 is a segmented perspective view illustrating the manner in which the various tabs on the planar strip of FIG. 3 have been formed to achieve the operative purposes of the invention.

A DETAILED DESCRIPTION OF THE INVENTION

For purposes of promoting an understanding of the principles of the invention, reference will now be made to the embodiments illustrated in the drawings and specific language will be used to describe same. It will nevertheless be understood that no limitation of the scope of the invention is thereby intended, there being contemplated such alterations and modifications of the illustrated device, and such further applications of the principles of the invention as disclosed herein, as would normally occur to one skilled in the art to which the invention pertains.

In FIG. 1, the strap wrench 10 of the invention is illustrated in a perspective drawing. Wrench 10 is comprised of a semi-rigid, form retaining, wrap around, planar strip 11. Planar strip 11 may be fabricated from sheet metal or plastic sheet stock. Wrench 10 includes a flexible pull cord 12 and a pull handle 13 attached to the cord.

A first end of the wrap around strip 11 is equipped with pull cord guides 14 which are configured so as to provide a passageway 15 through which a portion of wrap around strip 11 is passed so as to form a slide adjustable loop having an opening 30 which may be set to coincide with the diameters of various objects to be rotated by wrench 10.

At the distal end of wrap around strip 11 are tabs 17 which serve both as pull cord guides and the means whereby pull cord 12 is coupled to wrap around strip 11. A pin 19 passes through opening 18 (best seen in FIG. 3) to capture a loop in pull cord 12 and maintain it coupled to wrap around strip 11. Intermediate between pull guides 17 and 14 is an additional pair of pull cord guides 16.

As indicated in FIGS. 1 and 2, pull cord 12 is wrapped about wrap around 11 and guided in its passage by pull cord guides 14, 16 and 17.

Because wrap around strip 11 is formed of a semi-rigid, shape retaining medium, the size of loop opening 30 can be adjusted readily by simply squeezing the loop or pulling it slightly apart so that the portion of wrap around strip 11 passes backwards or forwards through the passage 15 at the base of pull cord guide 14. Loop opening 30 may be adjusted to the approximate size of the object to be rotated by wrench 10. Because strip 11 maintains its shape, the wrench may be readily installed on that object. For example, FIG. 2 illustrates wrench 10 in use on an oil filter for an automotive engine. Wrap around strip 11 has been passed over the outer diameter of oil filter 20. A simple squeeze has tightened the loop opening 30 about oil filter 20. Pull cord 12 had been wrapped about strip 11 and placed within guides 14, 16 and 17 prior to sliding the wrench 10 onto oil filter 20. With the simple squeeze to adjust the loop of wrap around strip 10 to conform to the diameter of oil filter 20, a straight line pull P on pull cord handle 13 will transmit a force which acts in a straight line tangential to oil filter 20 causing the oil filter to rotate in a direction so as to remove it from its mount on an automobile engine. As the oil filter 20 rotates, the point of contact with the oil filter by pull cord 12 remains at a point of tangency and a continued straight line pull P on cord 12 continues the rotation of oil filter 20. Pull cord 20 may be of sufficient length and wrapped several times about wrap around strip 11 so as to completely unscrew the oil filter with one complete pull of cord 12.

Note that any force exerted by the pull P on cord 12 operates at a point tangent to the oil filter and along a line removed from the axis A of oil filter 20. The force applied, via a flexible cord 12, thus acts at a distance from the axis of rotation A and along a straight line making tangential contact with the object to be rotated.

Wrap around strip 11 may be fabricated by punching process, molding, or other well known manufacturing techniques. In FIG. 3, the wrap around strip 11 is indicated as being punched from a sheet metal. To conserve drawing space, the drawing has been segmented. Flat tabs 14, 16 and 17 extend outward from the side of wrap around strip 11. Tabs 17 include holes 18 which will accept pin 19, shown in FIG. 1, for retaining pull cord 12 in position at the fore end of strip 11. These tabs are then formed, again by bending or molding techniques to assume the shapes similar to those indicated in FIG. 4. These shapes implement the operative functions of the invention allowing the tabs 14, 16 and 11, in their upright position shown, to serve as guides for pull cord 12 when cord 12 is wrapped about wrap around strip 11. The passageway 15 formed at the base of tabs 14, in FIG. 4, permits a portion of strip 11 to pass through that passageway so as to form a loop within strip 11. A pin 19 will be passed through tabs 17 to secure pull cord 12 in position.

What has been disclosed is a strap wrench made up of a semi-rigid, form retaining, planar strip wrap around. This wrap around is formed into a shape retaining loop, the opening of the loop being readily adjustable. Because of the semi-rigid, form retaining characteristics of the wrap around strip, the loop will retain its shape and size as it is moved about and positioned over an object to be rotated. A simple squeeze of the strip will conform the size of the loop to the outer diameter of the object to be rotated. A flexible pull cord is attached to the fore end of the semi-rigid, form retaining strip and wrapped about the strip prior to or as the strip is placed about the object to be rotated. A simple straight line pull on the flexible cord exerts a force which acts along a line which is tangent to the object to be rotated and which acts at a distance removed from the axis of that object.

Those skilled in the art will conceive of other embodiments of the invention which may be drawn from the disclosure herein. To the extent that such other embodiments are so drawn, it is intended that they shall fall within the ambit of protection provided by the claims herein.

Having described the invention in the foregoing description and drawings in such a clear and concise manner that those skilled in the art may readily understand and practice the invention, that which is claimed is:

1. A strap wrench comprising:

a semi-rigid, form retaining, wrap around, planar strip having a first end and a second end;

slide coupling means adjacent said first end for slidingly receiving said second end and forming said wrap around strip into a semi-rigid, form retaining, size adjustable loop;

a pull cord coupled to said second end of said wrap around strip; and said slide coupling means further comprises pull cord guide means for guiding said pull cord when said pull cord is wrapped about said size adjustable loop formed from said wrap around strip.

2. The strap wrench of claim 1 further comprising pull cord coupling means attached to said second end of said wrap around strip for coupling said pull cord to said second end.

3. The strap wrench of claim 1, said pull cord being flexible, and said wrench further comprising means coupling said pull cord to said second end of said wrap around strip for exerting, via said cord, a straight line of force generally acting along a line removed from the rotational axis of and tangential to the object to be turned by said wrench and acting in a plane generally orthoginal to said rotational axis of said object when said planar strip is wrapped around said object.

4. The strap wrench of claim 1 wherein said semi-rigid, form retaining wrap around comprises a generally flat strip of at least one of sheet metal and sheet plastic.

5. The strap wrench of claim 4 wherein said flat strip comprises conformable tabs.

6. The strap wrench of claim 5 further comprising a second one of said tabs for guiding said pull cord when said pull cord is wrapped about said size adjustable loop formed from said wrap around strip.

7. The strap wrench of claim 5 wherein said slide coupling means comprises a first one of said tabs.

8. The strap wrench of claim 5 further comprising a third one of said tabs, said third one of said tabs further comprising pull cord coupling means attached to said second end of said wrap around strip for coupling said pull cord to said second end.

9. The strap wrench of claim 7 wherein said first one of said tabs further comprises pull cord guide means for guiding said pull cord when said pull cord is wrapped about said size adjustable loop formed from said wrap around strip.

10. The strap wrench of claim 8 wherein said pull cord coupling means further comprises pull cord guide means for guiding said pull cord when said pull cord is wrapped about said size adjustable loop formed from said wrap around strip.

11. A strap wrench comprising:

a semi-rigid, form retaining, wrap around, planar strip having a first end and a second end;

slide coupling means adjacent said first end for slidingly receiving said second end and forming said wrap around strip into a semi-rigid, form retaining, size adjustable loop;

a pull cord coupled to said second end of said wrap around strip;

pull cord coupling means attached to said second end of said wrap around strip for guiding said pull cord when said pull cord is wrapped about said size adjustable loop formed from said wrap around strip; and said pull cord coupling means further comprises pull cord guide means for guiding said pull cord when said pull cord is wrapped about said size adjustable loop formed from said wrap around strip.

12. A strap wrench comprising:

a semi-rigid, form retaining, wrap around, planar strip having a first end and a second end;

slide coupling means adjacent said first end for slidingly receiving said second end and forming said wrap around strip into a semi-rigid, form retaining, size adjustable loop;

a pull cord coupled to said second end of said wrap around strip; and pull cord guide means attached to said wrap around strip for guiding said pull cord when said pull cord is wrapped about said size adjustable loop formed from said wrap around strip.

13. The strap wrench of claim 12 wherein said semi-rigid, form retaining wrap around comprises a generally flat strip of at least one of sheet metal and sheet plastic.

14. The strap wrench of claim 13 wherein said flat strip comprises conformable tabs.

15. The strap wrench of claim 14 further comprising a second one of said tabs for guiding said pull cord when said pull cord is wrapped about said size adjustable loop formed from said wraparound strip.

16. The strap wrench of claim 14 wherein said coupling means comprises a first one of said tabs.

17. The strap wrench of claim 16 wherein said slide coupling means further comprises pull cord guide means for guiding said pull cord when said pull cord is wrapped about said size adjustable loop formed from said wrap around strip.

18. The strap wrench of claim 14 further comprising a third one of said tabs, said third one of said tab means further comprising pull cord coupling means attached to said second end of said wrap around strip for coupling said pull cord to said second end.

19. The strap wrench of claim 18 wherein said pull cord coupling means further comprises pull cord guide means for guiding said pull cord when said pull cord is wrapped about said size adjustable loop formed from said wrap around strip.

* * * * *